US006160344A

United States Patent [19]

Cho et al.

[11] Patent Number: 6,160,344

[45] Date of Patent: Dec. 12, 2000

[54] CATHODE-RAY TUBE

[75] Inventors: Yoon-hyoung Cho, Kyungki-do; Hyun-jung Shin, Suwon-si; Do-houn Pyun, Kyungki-do; Kwang-sik Lee, Kyungki-do; Jae-jin An, Kyungki-do; Won-ho Kim, Suwon-si; Yong-geol Kwon, Kyungki-do, all of Rep. of Korea

[73] Assignee: Samsung Display Devices Co., Ltd., Suwon-si, Rep. of Korea

[21] Appl. No.: 09/058,544

[22] Filed: Apr. 10, 1998

[30] Foreign Application Priority Data

Apr. 12, 1997 [KR] Rep. of Korea ..... 97-13493
Apr. 4, 1998 [KR] Rep. of Korea ..... 98-11926

[51] Int. Cl.[7] ..... H01J 61/30

[52] U.S. Cl. ..... 313/477 R; 220/2.1 A; 220/2.1 R

[58] Field of Search ..... 313/402, 461, 313/473, 477 R; 220/2.1 R, 2.3 A, 2.1 A

[56] References Cited

U.S. PATENT DOCUMENTS 4,537,321 8/1985 Tokita ..... 313/477 R
4,537,322 8/1985 Okada et al. ..... 313/477 R
4,580,077 4/1986 Bakker et al. ..... 313/477
4,924,140 5/1990 Hirai et al. ..... 313/402

FOREIGN PATENT DOCUMENTS 6-36710 2/1994 Japan .
6-44926 2/1994 Japan .

*Primary Examiner*—Ashok Patel
*Attorney, Agent, or Firm*—Christie, Parker & Hale, LLP

[57] ABSTRACT

A faceplate panel for a cathode ray tube includes an exterior surface having a substantially flat shape, and an interior surface having a concave shape. The interior surface curves in a direction toward the flat exterior surface with a curvature radius $R_p$ satisfying the following condition:

$$1.2R \leqq R_p \leqq 8R,$$

where R=1.767×the diagonal length of the effective screen of the panel. Furthermore, a peripheral thickness t of the faceplate panel at the diagonal end of the effective screen satisfies the following condition:

$$B \leqq t \leqq A,$$

where B is the peripheral thickness of the panel at the diagonal end of the effective screen when a curvature radius $R_p$ of the interior surface is 8R, and A is the peripheral thickness of the panel on the diagonal end of the effective screen when a ratio of the light transmission at the peripheral portion of the diagonal end of the effective screen to the light transmission at the central portion of the effective screen is 0.85.

14 Claims, 4 Drawing Sheets

CATHODE-RAY TUBE

CROSS REFERENCE TO RELATED APPLICATION

This application claims priority to Korean patent application Nos. 97-13493, filed Apr. 12, 1997, and 98-11926, filed Apr. 4, 1998, the contents of which are incorporated herein by reference as if fully set forth.

BACKGROUND OF THE INVENTION (a). Field of the Invention

The present invention relates to a cathode-ray tube (CRT) having a faceplate panel and, more particularly, to a CRT faceplate panel for producing a uniform and clear visual image across the entire area of a viewing screen.

(b). Description of the Related Art

Generally, CRTs are designed to reproduce a picture image on a screen of a faceplate panel by exciting phosphors coated on an interior surface of the faceplate panel with electron beams emitted from an electron gun and passing through apertures of a color-selecting shadow mask. The shadow mask ensures that each electron beam lands on the correct phosphor.

The faceplate panel is usually formed with a transparent glass plate having curved interior and exterior surfaces. These curved surfaces enable the panel to withstand the high-vacuum pressure in the CRT and facilitate the landing of the electron beams on the phosphor screen.

However, such a faceplate panel involves a relatively broad light-reflecting exterior area in peripheral portions thereby deteriorating the brightness of those areas and distorting the appearance of the picture.

To remedy this problem, a glass plate having flat interior and exterior surfaces for the CRT faceplate panel has been developed. Such a panel employs a flat tension mask to perform the color-selecting function, the flat tension mask corresponding to the flat interior surface of the panel. The flat tension mask has predetermined horizontal and vertical tensional strengths to prevent the occurrence of a doming phenomenon.

However, in this type of panel, The visual images realized through the phosphor screen and refracted on the panel appear depressed to the user in the center portion of the viewing screen. The problem becomes more severe with larger-sized screens.

To overcome this drawback, Japanese Patent Laid-Open Publication Nos. Hei 6-44926 and 6-36710 introduce a CRT faceplate panel which is flat on an exterior surface but curved on an interior surface. However, the images realized through these inventions appear bulged outward. Further, because the peripheral portions of the panel are considerably thicker than center portions, the brightness of the screen is deteriorated.

SUMMARY OF THE INVENTION

It is an object of an embodiment of the present invention to provide a CRT faceplate panel for producing a uniform visual image across the entire area of a viewing screen.

It is another object of an embodiment of the present invention to provide a CRT faceplate panel having an optimum light transmission rate to realize a clear visual image across the viewing screen.

It is still another object of an embodiment of the present invention to provide a CRT having a faceplate panel for producing a clear visual image across the viewing screen.

In order to achieve these objects and others, an embodiment of the CRT faceplate panel includes an exterior surface having a substantially flat shape, and an interior surface having a concave shape. The interior surface curves in a direction toward the flat exterior surface with a curvature radius $R_p$ satisfying the following condition:

$$1.2R \leqq R_p \leqq 8R,$$

where R=1.767×the diagonal length of the effective screen of the CRT. Furthermore, a peripheral thickness t of the faceplate panel at the diagonal end of the effective screen satisfies the following condition:

$$B \leqq t \leqq A,$$

where B is the peripheral thickness of the panel at the diagonal end of the effective screen when a curvature radius $R_p$ of th interior surface is 8R, and A is the peripheral thickness of the panel at the diagonal end of the effective screen when the ratio of the light transmission at the peripheral portion at the diagonal end of the effective screen to the light transmission at the central portion of the effective screen is 0.85.

The described embodiment of the CRT includes a faceplate panel having a flat exterior surface and a curved interior surface, a funnel sealed to the rear of the faceplate panel, a shadow mask placed behind the faceplate panel, an electron gun mounted within a neck portion of the funnel, and aL deflection yoke placed around an outer periphery of the funnel.

The shadow mask has a curvature radius $R_s$ satisfying the following condition.

$$1.2R \leqq R_s \leqq 4R$$

where R=1.767×the diagonal length of effective screen of the CRT.

The interior surface of the faceplate panel has a curvature radius $R_p$ satisfying the following condition:

$$1.2R \leqq R_p \leqq 4R$$

where R=1.767×the diagonal length of effective screen of the CRT.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

Reference will now be made in detail to the preferred embodiment of the present invention, examples of which are illustrated in the accompanying drawings.

Figure 1:
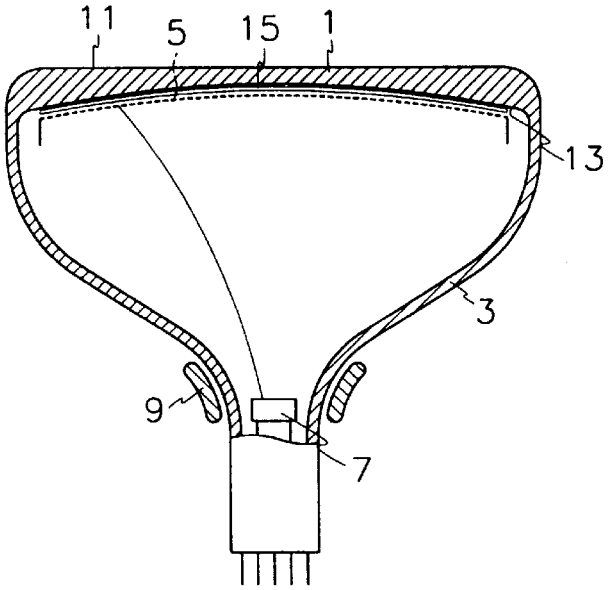
FIG. 1 is a partial sectional view of a CRT according to a preferred embodiment of the present invention.

FIG. 1 is a partial sectional view of a CRT according to a preferred embodiment of the present invention. As shown in FIG. 1, the inventive CRT includes a faceplate panel 1 having a phosphor screen 15, a funnel 3 sealed to the rear of the panel 1, a shadow mask 5 behind the panel 1 with the phosphor screen 15 interposed therebetween, an electron gun 7 mounted within the neck of the funnel 3, and a deflection yoke 9 placed around the outer periphery of the funnel 3. In such a CRT, visual images are produced by exciting phosphors on the phosphor screen 15 with electron beams emitted from the electron gun 7 and passing through the shadow mask 5, the shadow mask 5 performing a color-selecting function.

The panel 1 has a flat exterior surface 11 to minimize reflection of external light and produce clear visual images even in the peripheral edges of the viewing screen. In contrast, the interior surface 13 of the panel 1 is concave. That is, the interior surface 13 of the panel 1 is curved in a direction toward the flat exterior surface 11. This curved interior surface 13 is an essential feature of an embodiment of the present invention for producing a uniform visual image across the entire area of the viewing screen.

The shadow mask 5 has a curvature corresponding to the interior surface 13 of the panel 1. The inventive shadow mask 5 is formed using a pressing process. Accordingly, manufacture of the inventive shadow mask 5 is considerably easier and less costly to manufacture than the flat tension mask used in the prior art CRT.

Figure 2:
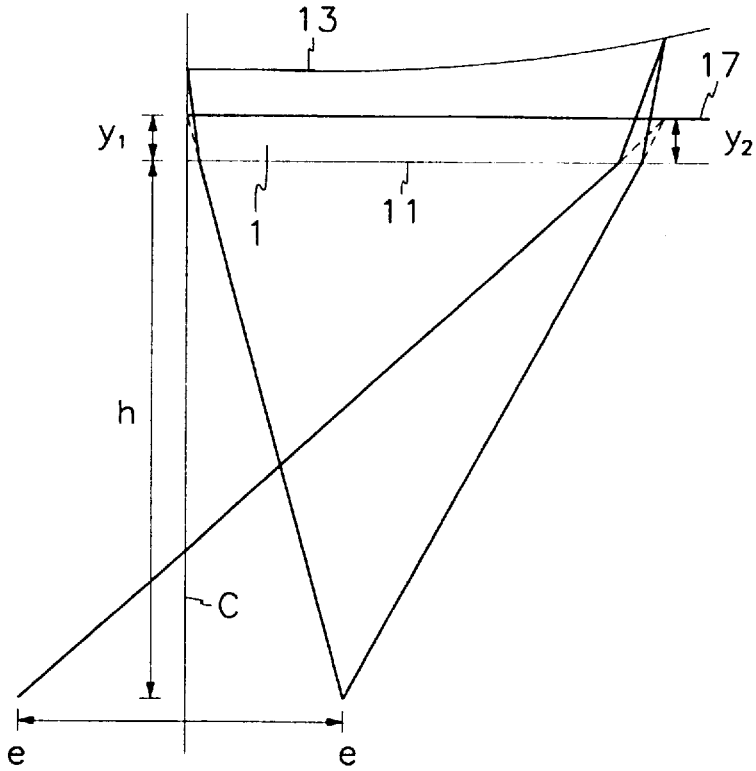
FIG. 2 is a diagram illustrating the relation between a visual image and the interior surface of the panel shown in FIG. 1.

Referring now to FIG. 2, shown is a diagram illustrating the relation between a visual image and the interior surface 13 of the panel 1. In the drawing, when the distance between the user and the exterior surface 11 is determined to be the horizontal length h of the effective screen, the curved interior surface 13 should be set to satisfy mathematical formula 1. This prevents the phenomenon in which the effective screen appears to have a concave shape to the user, and results in a uniform visual image.

Referring to FIG. 2, $$y_1-y_2 \leqq 0 \tag{1}$$

where $y_1$ is the distance between the exterior surface 11 and a visual image line 17 on a central axis of the faceplate panel 1, and $y_2$ is the distance between the exterior surface 11 and the visual image line 17 at the periphery of the faceplate panel 1. In the above formula, $y_1-y_2$ can be thought of as a measure of the degree of uniformity of the visual image.

The above effective screen is an imagined plane on the exterior surface 11 when the phosphor screen 15 is vertically projected thereon. The reason that the distance between the user and the exterior surface 11 is determined to be the horizontal length h of the effective screen is because the relation between the viewing angle and uniformity of the visual image can be properly judged from that distance.

Figure 3:
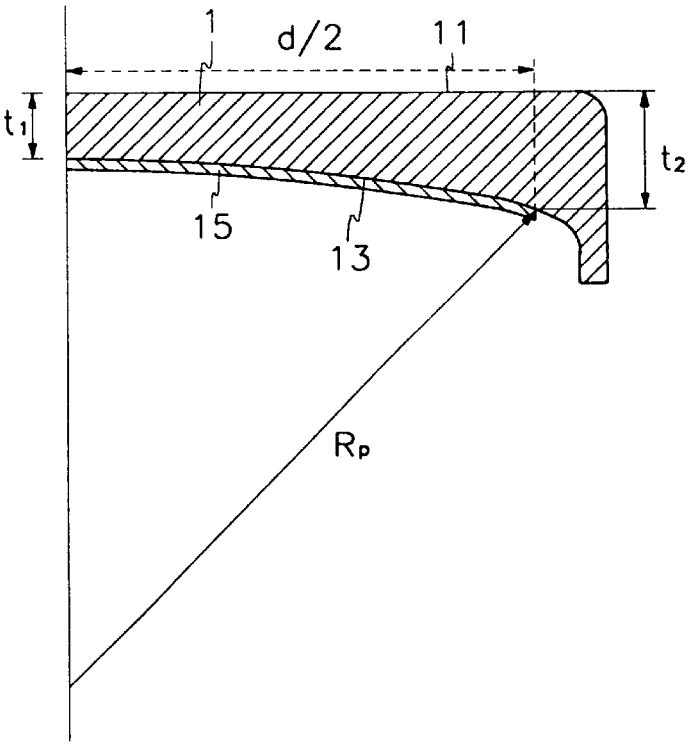
FIG. 3 is a partial sectional view illustrating a curvature radius of the interior surface of the panel shown in FIG. 1.

FIG. 3 is a schematic diagram illustrating the relation between the curvature radius $R_p$ of the interior surface 13 to the thicknesses $t_1$ and $t_2$ of the panel 1. Namely, $t_1$ indicates the thickness of the central portion Df the panel 1 while $t_2$ indicates the thickness of the peripheral portion of the panel 1 at the diagonal end of the effective screen. Because of the curvature of the interior surface 13, $t_2$ is larger than $t_1$.

The unit value R of the curvature radius $R_p$ is given by mathematical formula 2:

$$R=1.767\times d, \tag{2}$$

where d is the diagonal length of the effective screen. The above formula is derived from that published on Technical Papers of SID International Symposium in 1992 by Matsushita Corporation, Japan. The unit curvature radius R varies depending upon the employed panel type.

Figure 4:
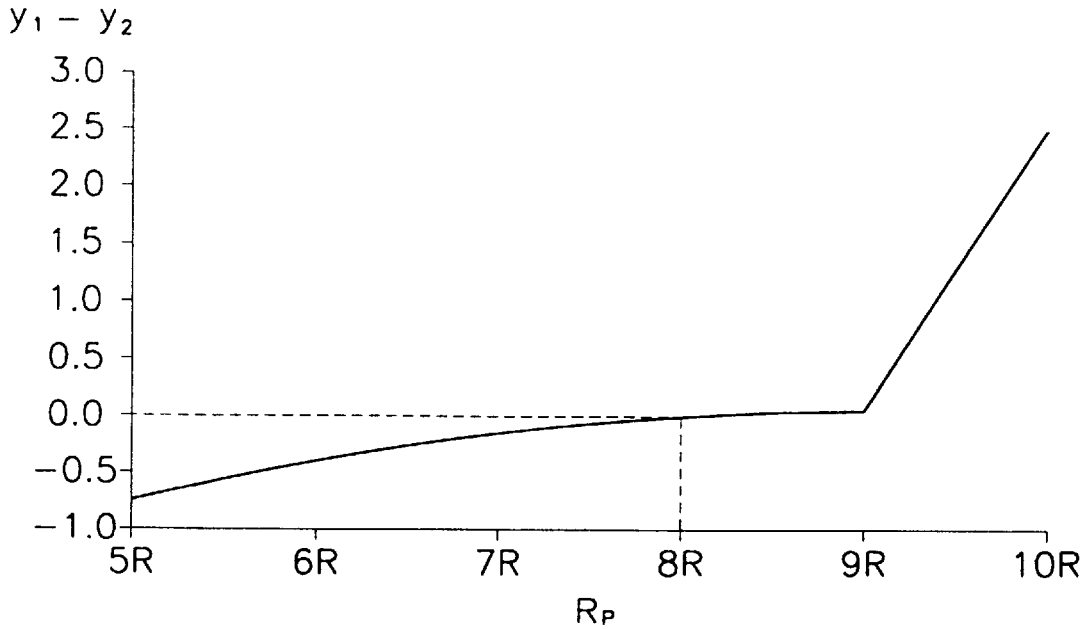
FIG. 4 is a graph illustrating the relation between the uniformity of the visual image to the curvature radius of the interior surface of the panel shown in FIG. 1.

FIG. 4 is a graph illustrating the relation between the uniformity $y_1-y_2$ of the visual image to the curvature radius $R_p$ of the interior surface 13 in a 17 inch CRT. As shown in the drawing, mathematical formula 1 is satisfied in the range of 8R or less. This means that a uniform visual image can be obtained in the range of 8R or less. However, in a range exceeding 8R, the visual image appears to be depressed in the center of the viewing screen. This relation is also applicable to other type CRTs. Therefore, in this preferred embodiment, the curvature radius $R_p$ of the interior surface 13 of the panel 1 is determined to be in the range of 8R or less.

The resulting large thickness of the peripheral portion of the panel 1, however, acts to deteriorate brightness. Thus, in order to overcome such an undesirable effect, the ratio of the light transmission at the periphery of the effective screen to the center of the effective screen should be relatively high. As a result, in this preferred embodiment, the ratio of the light transmission at the peripheral portion at the diagonal end of the effective screen to the light transmission at the center of the effective screen is determined to be 0.85 or greater. This value is adopted in consideration of the correlation among the panel weight, production cost and productivity.

Accordingly, a clear glass having a central light transmission rate of 85% or more can be used for the panel 1.

Measurement of the light transmission rate of the clear glass panel is conducted using mathematical formula 3:

$$\text{Light Transmission Rate } (\%)=(e^{-at}-0.08)\times 100, \tag{3}$$

where a=0.006090 and t is the central thickness of the panel.

Figure 5:
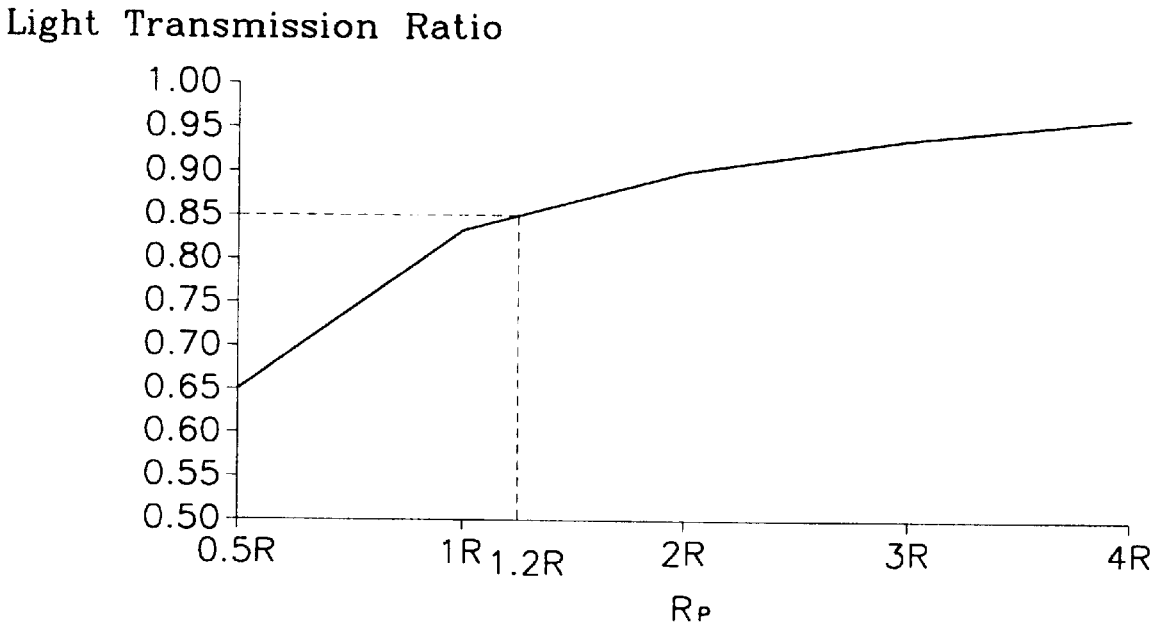
FIG. 5 is a graph illustrating the relation between the light transmission ratio of the center and periphery of the panel to the curvature radius of the interior surface of the panel shown in FIG. 1.

FIG. 5 is a graph illustrating the relation between the curvature radius $R_p$ and the ratio of the light transmission at the peripheral portion at the diagonal end of the effective screen to the light transmission at the center of the effective screen. As shown in FIG. 5, when the light transmission ratio is determined to be 0.85 or greater, the curvature radius $R_p$ becomes 1.2R or more. In other words, with the curvature radius $R_p$ of 1.2R or more, the light transmission ratio becomes 0.85 or greater, thereby producing good brightness. However, with the curvature radius $R_p$ of less than 1.2R, the light transmission ratio becomes less than 0.85 such that brightness is deteriorated.

Therefore, referring to FIGS. 4 and 5, the curvature radius $R_p$ of the interior surface 13 of the panel 1 according to a preferred embodiment of the present invention satisfies mathematical formula 4:

$$1.2R \leqq R_p \leqq 8R, \tag{4}$$

where R=1.767×the diagonal length of the effective screen of the CRT.

When the curvature radius $R_p$ is in the above range, the phenomenon in which the visual image appears to be depressed in the center of the viewing screen can be prevented, such that good brightness can be obtained.

The panel types capable of satisfying mathematical formula 4 are listed in Table 1.

TABLE 1

| | C(mm) | A(mm) | B(mm) |
|---|---|---|---|
| 15 inch | 10.5 | 34.7 | 13.65 |
| 17 inch | 11.5 | 35.7 | 15.10 |
| 19 inch | 12.0 | 36.2 | 16.03 |
| 25 inch | 13.0 | 37.2 | 18.22 |
| 29 inch | 14.0 | 38.2 | 20.00 |
| 32 inch | 15.0 | 39.2 | 21.74 |

where C is the central thickness $t_1$ of the panel 1, A is the peripheral thickness $t_2$ of the panel 1 at the diagonal end of the effective screen when the light transmission ratio is 0.85, and B is the peripheral thickness $t_2$ of the panel 1 when the curvature radius $R_p$ is 8R.

Referring to Table 1, the peripheral thickness $t_2$ of the panel 1 at the end of the effective screen can be determined using mathematical formula 5. This range is given considering the correlation among the factors of thickness, light transmission ratio, and curvature radius.

Referring to Table 1:

$$B \leqq t_2 \leqq A \quad (5)$$

In the 17 inch panel, the thickness $t_2$ can be derived from mathematical formula 5 and Table 1 as 15.10 mm$\leqq t_2 \leqq$35.7 mm.

Figure 7:
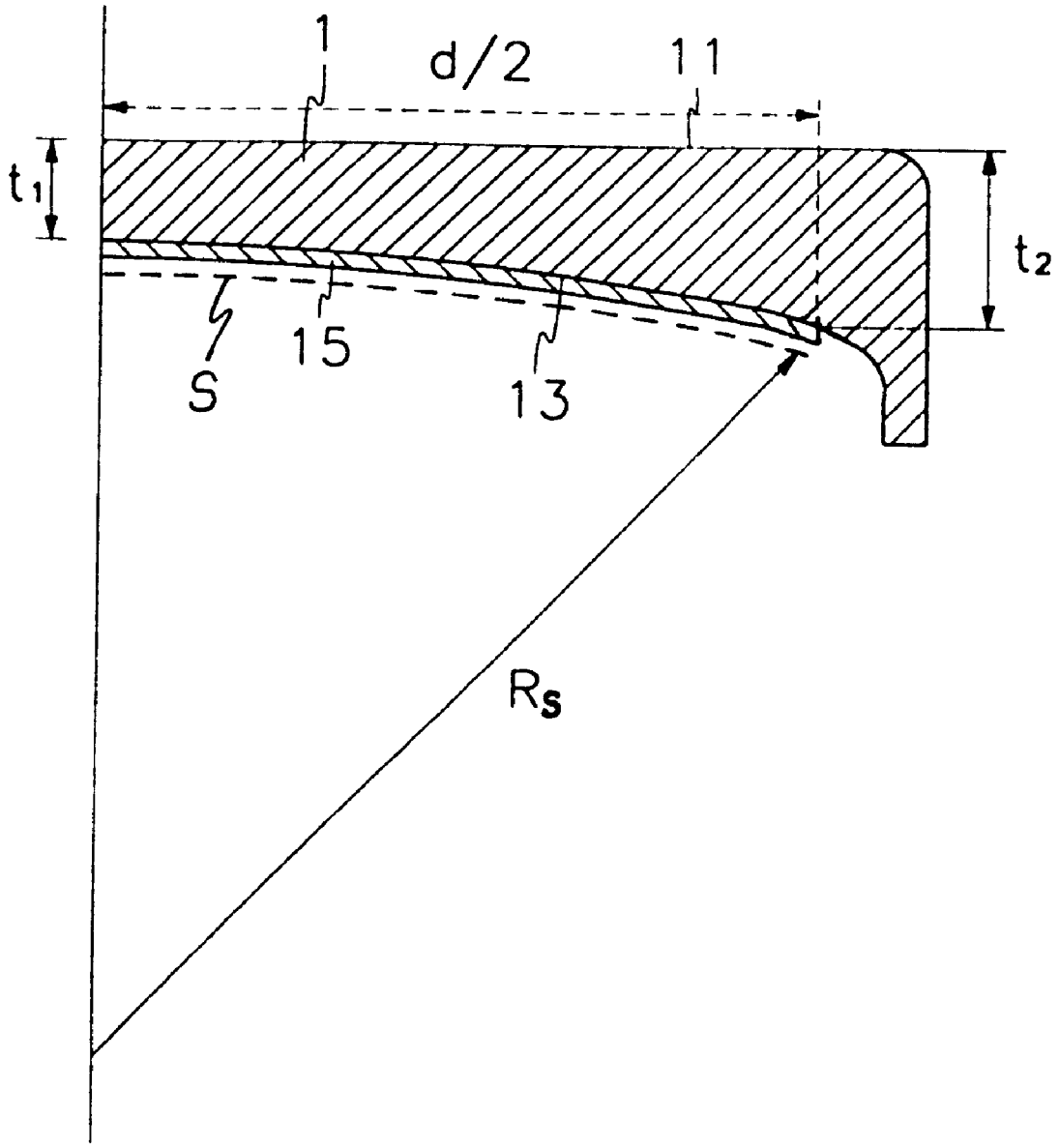
FIG. 7 is a partial sectional view illustrating a curvature radius of the shadow mask shown in FIG. 1.

According to another preferred embodiment of the present invention, the range of curvature radius $R_p$ defined in mathematical formula 4 can be further limited in view of the characteristics of the shadow mask 5. The shadow mask 5 should have a curvature radius $R_s$ identical with or smaller than the curvature radius $R_p$ of the interior surface 13 of the panel 1 (see FIG. 7). However, when the shadow mask 5 is formed with a curvature radius of more than 4R, it is possible for the shadow mask 5 to become distorted.

Thus, the shadow mask 5 should have a curvature radius $R_s$ capable of satisfying mathematical formula 6 while the curvature radius $R_p$ of the panel 1 defined in mathematical formula 4 should be limited by mathematical formula 7:

$$1.2R \leqq R_s \leqq 4R, \quad (6)$$

$$1.2R \leqq R_p \leqq 4R, \quad (7)$$

Figure 6:
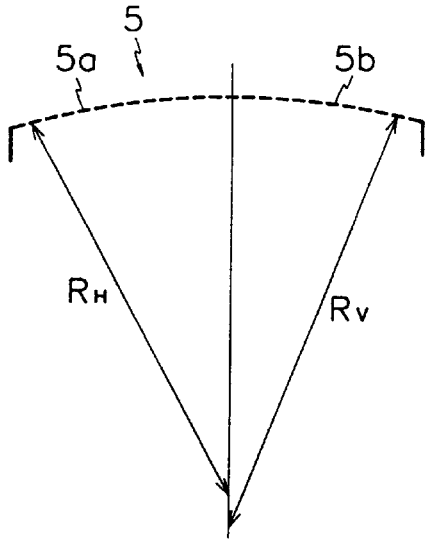
FIG. 6 is a diagram illustrating a horizontal curvature radius and a vertical curvature radius of the shadow mask shown in FIG. 1.

FIG. 6 is a schematic diagram illustrating a horizontal curvature radius and a vertical curvature radius of the shadow mask 5. In order to minimize the occurrence of the doming phenomenon, it is preferable that the horizontal curvature radius $R_H$ of the shadow mask 5, shown in FIG. 6 be identical with or smaller than the vertical curvature radius $R_V$. That is, the shadow mask 5 should satisfy mathematical formula 8:

$$R_H \leqq R_V, \quad (8)$$

When the curvature radius $R_p$ is defined by mathematical formula 7, B in Table 1 is changed into B' in Table 2.

TABLE 2

| | 15 inch | 17 inch | 19 inch | 25 inch | 29 inch | 32 inch |
|---|---|---|---|---|---|---|
| B' (mm) | 16.8 | 18.7 | 20.7 | 23.45 | 25.97 | 28.49 |

where B' is the peripheral thickness $t_2$ of the panel 1 on the diagonal end of the effective screen when the curvature radius $R_p$ is 4R.

Therefore, mathematical formula 5 can also be changed into mathematical formula 9:

$$B' \leqq t_2 \leqq A, \quad (9)$$

Therefore, in the 17 inch panel, the thickness $t_2$ can be derived from mathematical formula 8 and Table 2 as 18.7 mm$\leqq t_2 \leqq$35.7 mm.

As described above, in the inventive CRT faceplate panel, the curvature radius $R_p$ of the interior surface 13 of the panel 1 is in the range of $1.2R \leqq R_p \leqq 8R$ so that the visual image appears uniformly and clearly across the entire area of the viewing screen.

While the present invention has been described in detail with reference to the preferred embodiments, those skilled in the art will appreciate that various modifications and substitution can be made thereto without departing from the spirit and scope of the present invention as set forth in the appended claims.

What is claimed is:

1. A cathode ray tube having a faceplate panel, the faceplate panel comprising:

an exterior surface having a substantially flat shape; and an interior surface having a substantially concave shape with a curvature radius $R_p$ satisfying the following condition:

$$1.2R \leqq R_p \leqq 8R,$$

where R=1.767×a diagonal length of an effective screen of the cathode ray tubes;

wherein the ratio of light transmission at a peripheral portion on a diagonal end of the effective screen of the cathode ray tube to light transmission at a central portion of the effective screen is 0.85 or greater.

2. The cathode ray tube of claim 1 wherein the interior surface has a curvature radius $R_p$ satisfying the following condition:

$$1.2R \leqq R_p \leqq 4R,$$

where R=1.767×a diagonal length of an effective screen of the cathode ray tube.

3. The cathode ray tube of claim 1 wherein the faceplate panel satisfies the following condition:

$$y_1 - y_2 \leqq 0$$

where $y_1$ is a distance between the exterior surface and a visual image on a central axis of the faceplate panel and $y_2$ is a distance between the exterior surface and a visual image on a periphery of the faceplate panel.

4. A cathode ray tube having a faceplate panel, the faceplate panel comprising:

an exterior surface having a substantially flat shape;

an interior surface having a substantially concave shape; and a central portion having a light transmission rate of 85% or more.

5. A cathode ray tube having a faceplate panel, the faceplate panel comprising:

an exterior surface having a substantially flat shape; and an interior surface having a substantially concave shape;

wherein the ratio of light transmission at a peripheral portion on a diagonal end of an effective screen of the cathode ray tube to light transmission at a central portion of the effective screen is 0.85 or greater.

6. The cathode ray tube of claim 5 wherein the light transmission rate in the central portion of the effective screen is 85% or more.

7. A faceplate panel for a cathode ray tube, comprising:

an exterior surface having a substantially flat shape; and an interior surface having a substantially concave shape;

wherein a peripheral thickness $t_2$ of the faceplate panel on a diagonal end of an effective screen of the cathode ray tube satisfies the following condition:

$$B \leqq t_2 \leqq A,$$

where B is a peripheral thickness of the faceplate panel on the diagonal end of the effective screen when a curvature radius $R_p$ of the interior surface is 8R, where R=1.767×a diagonal length of the effective screen, and A is a peripheral thickness of the faceplate panel on the diagonal end of the effective screen when the ratio of light transmission at a peripheral portion of the faceplate panel on the diagonal end of the effective screen to light transmission at a central portion of the effective screen is 0.85.

8. The faceplate panel of claim 7 wherein the peripheral thickness $t_2$ of the faceplate panel on the diagonal end of the effective screen satisfies the following condition:

$$B' \leqq t_2 \leqq A,$$

where B' is a peripheral thickness of the faceplate panel on the diagonal end of the effective screen where a curvature radius $R_p$ of the interior surface is 4R.

9. A faceplate panel for a cathode ray tube, comprising:

an exterior surface having a substantially flat shape; and an interior surface having a substantially concave shape;

wherein the interior surface has a curvature radius $R_p$ satisfying the following condition:

$$1.2R \leqq R_p \leqq 8R,$$

where R=1.767×a diagonal length of an effective screen of the cathode ray tube; and wherein a peripheral thickness $t_2$ of the faceplate panel on a diagonal end of an effective screen satisfies the following condition:

$$B \leqq t_2 \leqq A,$$

where B is a peripheral thickness of -he faceplate panel on the diagonal end of the effective screen when a curvature radius $R_p$ of the interior surface is 8R, and A is a peripheral thickness of the faceplate panel on the diagonal end of the effective screen when the ratio of light transmission at a peripheral portion on the diagonal end of the effective screen to light transmission at a central portion of the effective screen is 0.85.

10. A cathode ray tube, comprising:

a faceplate panel comprising an exterior surface with a substantially flat shape, an interior surface having a substantially concave shape, and a central portion having a light transmission rate of 85% or more;

a funnel sealed to a rear of the faceplate panel;

a shadow mask placed behind the faceplate panel;

an electron gun mounted within a neck portion of the funnel; and a deflection yoke placed around an outer periphery of the funnel;

wherein the interior surface of the faceplate panel has a curvature radius $R_p$ satisfying the following condition:

$$1.2R \leqq R_p \leqq 4R,$$

where R=1.767×a diagonal length of an effective screen of the cathode ray tube; and wherein the shadow mask has a curvature radius $R_s$ satisfying the following condition:

$$1.2R \leqq R_s \leqq 4R.$$

11. A cathode ray tube, comprising:

a faceplate panel comprising an exterior surface with a substantially flat shape and an interior surface having a substantially concave shape;

a funnel sealed to a rear of the faceplate panel;

a shadow mask placed behind the faceplate panel;

an electron gun mounted within a neck portion of the funnel; and a deflection yoke placed around an outer periphery of the funnel;

wherein the interior surface of the faceplate panel has a curvature radius $R_p$ satisfying the following condition:

$$1.2R \leqq R_p \leqq 4R,$$

where R=1.767×a diagonal length of an effective screen of the cathode ray tube; and wherein the shadow mask has a curvature radius $R_s$ satisfying the following condition:

$$1.2R \leqq R_s \leqq 4R,$$

wherein the effective screen has a ratio of 0.85 or greater of light transmission at a peripheral portion of the faceplate panel on a diagonal end of the effective screen to light transmission at a central portion of the effective screen.

12. The cathode ray tube of claim 11 wherein the central portion of the effective screen has a light transmission rate of 85% or more.

13. A cathode ray tube, comprising:

a faceplate panel comprising an exterior surface with a substantially flat shape and an interior surface having a substantially concave shape;

a funnel sealed to a rear of the faceplate panel;

a shadow mask placed behind the faceplate panel;

an electron gun mounted within a neck portion of the funnel; and a deflection yoke placed around an outer periphery of the funnel;

wherein the interior surface of the faceplate panel has a curvature radius $R_p$ satisfying the following condition:

$$1.2R \leqq R_p \leqq 4R,$$

where R=1.767×a diagonal length of an effective screen of the cathode ray tube;

wherein the shadow mask has a curvature radius $R_s$ satisfying the following condition:

$$1.2R \leqq R_s \leqq 4R; \text{ and}$$

wherein the faceplate panel satisfies the following condition:

$$y_1-y_2 \leqq 0,$$

where $y_1$ is a distance between the exterior surface of the faceplate panel and a visual image on a central axis of the faceplate panel and $y_2$ is a distance between the exterior surface of the faceplate panel and a visual image on a periphery of the faceplate panel.

14. A cathode ray tube, comprising:

a faceplate panel comprising an exterior surface with a substantially flat shape and an interior surface having a substantially concave shape;

a funnel sealed to a rear of the faceplate panel;

a shadow mask placed behind the faceplate panel;

an electron gun mounted within a neck portion of the funnel; and a deflection yoke placed around an outer periphery of the funnel;

wherein the interior surface of the faceplate panel has a curvature radius $R_p$ satisfying the following condition:

$$1.2R \leqq R_p \leqq 4R,$$

where R=1.767×a diagonal length of an effective screen of the cathode ray tube;

wherein the shadow mask has a curvature radius $R_s$ satisfying the following condition:

$$1.2R \leqq R_s \leqq 4R; \text{ and}$$

wherein the shadow mask has a horizontal curvature radius and a vertical curvature radius satisfying the following condition:

$$R_H \leqq R_v,$$

where $R_H$ is the horizontal curvature radius and $R_v$ is the vertical curvature radius.

* * * * *